US008757432B2

(12) United States Patent
Muntzing et al.

(10) Patent No.: US 8,757,432 B2
(45) Date of Patent: Jun. 24, 2014

(54) TOP-DISPENSING ABSORBENT SHEET DISPENSER

(75) Inventors: Janne Muntzing, Saro (SE); John S. Formon, Appleton, WI (US)

(73) Assignee: SCA Tissue North America LLC, Philadelphia, PA (US)

( * ) Notice: Subject to any disclaimer, the term of this patent is extended or adjusted under 35 U.S.C. 154(b) by 771 days.

(21) Appl. No.: 11/227,067

(22) Filed: Sep. 16, 2005

(65) Prior Publication Data

US 2006/0102642 A1 May 18, 2006

Related U.S. Application Data

(63) Continuation of application No. PCT/US2004/037743, filed on Nov. 12, 2004.

(51) Int. Cl.
*A47K 10/24* (2006.01)
*B65H 1/00* (2006.01)

(52) U.S. Cl.
USPC ..... 221/48; 221/49; 221/46; 221/63; 221/62; 221/38; 204/494; 428/43

(58) Field of Classification Search
USPC ..... 221/49, 48, 46, 63, 62, 38; 204/494; 428/43
See application file for complete search history.

(56) References Cited

U.S. PATENT DOCUMENTS 1,072,859 A * 9/1913 Kingsley ..... 221/59
1,707,578 A * 4/1929 Shaffer ..... 221/62
3,172,563 A * 3/1965 Harwood ..... 221/48
3,425,595 A * 2/1969 Shapira ..... 221/52
3,756,453 A * 9/1973 Griffioen et al. ..... 221/41
3,784,055 A * 1/1974 Anderson ..... 221/46
3,868,052 A * 2/1975 Rockefeller ..... 225/106
3,994,417 A * 11/1976 Boedecker ..... 221/48
4,138,034 A * 2/1979 McCarthy ..... 221/48
4,219,129 A * 8/1980 Sedgwick ..... 221/63
4,328,907 A * 5/1982 Beard ..... 221/63
4,553,275 A * 11/1985 Goldstein ..... 4/605
4,725,469 A * 2/1988 Summerfield ..... 428/43
4,963,406 A * 10/1990 Gooding et al. ..... 428/43
5,080,255 A * 1/1992 Windorski ..... 221/45
5,213,243 A * 5/1993 Landon ..... 224/277
5,462,197 A * 10/1995 Pound ..... 221/46
5,516,001 A 5/1996 Muckenfuhs et al.
5,540,354 A * 7/1996 Annand ..... 221/52
5,542,568 A * 8/1996 Julius ..... 221/63
5,666,787 A * 9/1997 Young et al. ..... 53/438
5,810,200 A 9/1998 Trokhan
5,882,767 A * 3/1999 Simmons, Jr. ..... 428/126
5,992,683 A * 11/1999 Sigl ..... 221/59

(Continued)

*Primary Examiner* — Gene O. Crawford
*Assistant Examiner* — Rakesh Kumar
(74) *Attorney, Agent, or Firm* — Drinker Biddle & Reath LLP

(57) ABSTRACT

A pop-up type dispenser is provided for paper towels, in which a specially sized and shaped hole in the dispenser top cooperates with a stack of paper towels housed in the dispenser. The towel stack has at least two interfolded webs of perforated absorbent sheet material in which the perforations of one web are not aligned with the perforations of an adjacent web. The towels may be withdrawn through the opening one sheet at a time, by a user pulling on a first sheet of said one web protruding through said opening without needing to touch a next sheet on the adjacent web or a subsequent sheet on the one web.

16 Claims, 3 Drawing Sheets

(56) References Cited

U.S. PATENT DOCUMENTS

| | | | | |
|---|---|---|---|---|
| 6,000,538 | A * | 12/1999 | Lee | 206/233 |
| 6,021,919 | A * | 2/2000 | Kelly | 221/25 |
| 6,045,002 | A * | 4/2000 | Wierschke | 221/48 |
| 6,109,430 | A * | 8/2000 | Bando et al. | 206/207 |
| 6,213,344 | B1 * | 4/2001 | Hill | 221/38 |
| 6,213,346 | B1 * | 4/2001 | Skerrett et al. | 221/48 |
| 6,286,712 | B1 * | 9/2001 | Craig et al. | 221/48 |
| 6,299,016 | B1 * | 10/2001 | Bando et al. | 221/33 |
| 6,543,642 | B1 * | 4/2003 | Milliorn | 221/46 |
| 6,550,633 | B2 * | 4/2003 | Huang et al. | 221/45 |
| 6,571,985 | B2 * | 6/2003 | Wilkes et al. | 221/63 |
| 6,595,386 | B2 * | 7/2003 | Vogel et al. | 221/48 |
| 6,612,462 | B2 * | 9/2003 | Sosalla et al. | 221/48 |
| 6,644,501 | B2 * | 11/2003 | Iida | 221/48 |
| 6,905,748 | B2 * | 6/2005 | Sosalla | 428/43 |
| 6,959,834 | B2 * | 11/2005 | McDonald | 221/63 |
| 7,273,156 | B2 * | 9/2007 | Gao et al. | 221/47 |
| 7,481,393 | B2 * | 1/2009 | Trinko et al. | 242/588.3 |
| 2002/0162765 | A1 * | 11/2002 | Okin et al. | 206/494 |
| 2002/0192433 | A1 * | 12/2002 | Huang et al. | 428/194 |
| 2003/0062376 | A1 * | 4/2003 | Sears et al. | 221/48 |
| 2003/0230591 | A1 * | 12/2003 | Jordan et al. | 221/38 |
| 2004/0149833 | A1 * | 8/2004 | Donnelly et al. | 239/44 |
| 2004/0169047 | A1 * | 9/2004 | Behnke et al. | 221/45 |
| 2005/0269344 | A1 * | 12/2005 | Madsen et al. | 221/63 |
| 2006/0027590 | A9 * | 2/2006 | Tramontina et al. | 221/46 |

* cited by examiner

TOP-DISPENSING ABSORBENT SHEET DISPENSER

CROSS REFERENCE TO RELATED APPLICATIONS

This application is a continuation of International Application No. PCT/US04/37743 filed on Nov. 12, 2004, which designated the United States of America, the entire contents of which are hereby incorporated by reference.

BACKGROUND OF THE INVENTION

1. Field of the Invention

The invention relates to a dispenser for serially dispensing folded absorbent sheet products through an upwardly oriented opening, and more preferably relates to an improved top-dispensing paper towel dispenser.

2. Description of Related Art

Paper towel dispensers used in commercial establishments generally are wall-mounted and dispense downwardly. Dispensers in which the towels can be removed from above tend not to be dispensers as such, but rather open trays such as the INSIGHT® Counter Top Folded Towel Dispenser marketed by Kimberly-Clark. Such open tray dispensers permit users to take more than one towel at a time, and thus do not curtail waste as effectively as a dispenser in which the towels are removed one-at-a-time. Also, with most of the towels being exposed in such trays, there is a danger that a large part of the stack could get wet or otherwise contaminated by a previous user.

One-at-a-time top-dispensing dispensers, sometimes referred to as "pop-up" dispensers, are most often used for facial tissues, in which a bolt of discrete, separated tissues is dispensed one-at-a-time, although the one-at-a-time dispensing is not entirely reliable. That is, the tissues have a tendency to fall back down into the dispenser, particularly when there is a relatively small portion of the tissues remaining, such that a tissue suspended from the top opening is draped over a longer distance before resting on the remaining tissues within the dispenser. This gives rise to the disadvantage of a next user having to reach into the dispenser in order to get the tissues coming out again, which is all the more undesirable if the dispenser is in a public place.

When the tissues in such a dispenser are an interfolded stack, it is particularly difficult to prevent fallback when the height of the dispenser exceeds the length of one panel of the folded tissue. Therefore, pop-up tissue dispensers are frequently no taller than they are wide, which plays a limiting role in their capacity and increases the frequency with which they must be refilled.

Also on the market are top-dispensing cardboard boxes of "wipers" (high basis weight disposable utility towels), sold by Kimberly-Clark under the trade name WypAll®, in which two webs of interfolded and pre-perforated wipers are dispensed through a relatively large diamond-shaped opening in the top of the box. In that product, however, if it is attempted to remove a wiper from the box upwardly in a one-handed operation, the wiper being pulled does not separate from the next adjacent wiper on the same web (which is actually the third sheet in the order of dispensing, the second sheet being that on the overlapped adjacent web). It is instead necessary for the user to hold the third wiper in order to tear off the first, after which not only the second wiper but also a rather large portion of the third wiper project upwardly through the opening.

U.S. Pat. No. 5,810,200 describes a pop-up dispenser in which a single web of pre-perforated tissues may be dispensed serially, by use of a spring-loaded tab 18 that registers within each line of perforations as a tissue is being withdrawn. This patent does not appear to address the above-described fallback problems, and entails a somewhat more complicated structure to deal with the tissues being initially interconnected within the dispenser.

SUMMARY OF THE INVENTION

It is therefore an object of the invention to address and alleviate, at least in part, the disadvantages described above in connection with the prior art, by providing a dispenser for absorbent sheet products, comprising a body that covers a stack of paper products to be disposed within the dispenser, the body comprising an opening on an upper surface thereof, in which the opening has a size and shape such that a stack of absorbent sheet products to be disposed within the dispenser and formed of at least two interfolded webs of perforated absorbent sheet material in which the perforations of one web are not aligned with the perforations of an adjacent web may be withdrawn through the opening one sheet at a time, by a user pulling on a first sheet of the one web protruding through the opening without the user needing to touch a next sheet on the adjacent web or a subsequent sheet on the one web, the next sheet on the adjacent web protruding through the opening each time a first sheet on the one web is withdrawn and detached from the one web, without the adjacent sheet falling downwardly from the opening back into the body.

The invention is embodied not only in the dispenser itself, but also in the combination of the dispenser filled with a stack of absorbent sheet products housed therein, the absorbent sheet products having a structure and arrangement particularly well suited for serial dispensing in the dispenser of the invention, as will be discussed hereinbelow in the context of several preferred embodiments.

The invention also relates to the use of a stack of interfolded absorbent sheet products as described hereinbelow, in a dispenser according to the invention.

BRIEF DESCRIPTION OF THE DRAWINGS

Other objects, features and advantages of the invention will become more apparent after reading the following detailed description of preferred embodiments of the invention, given with reference to the accompanying drawings, in which.

DETAILED DESCRIPTION OF PREFERRED EMBODIMENTS

Figure 1:
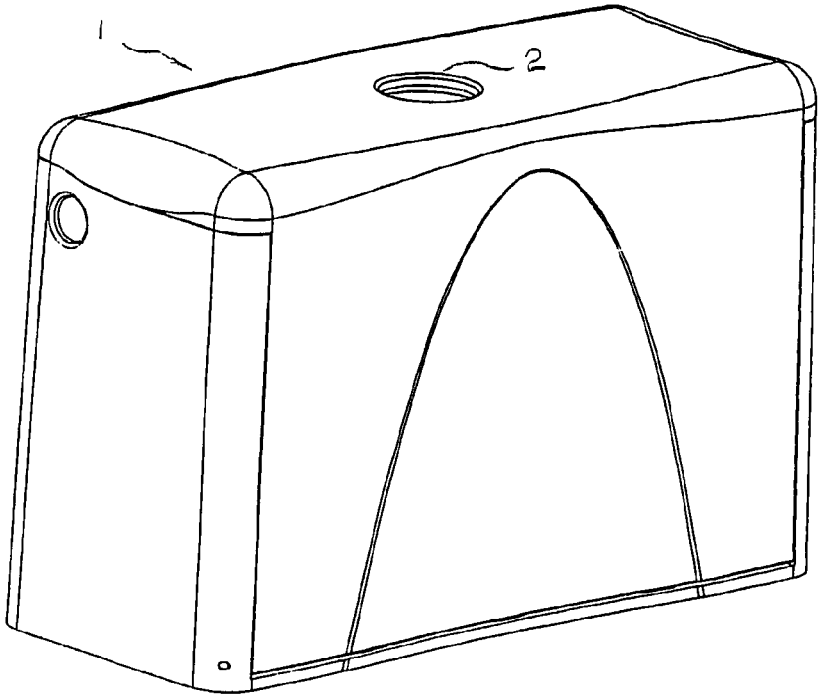
FIG. 1 is a perspective view showing an embodiment of a dispenser according to the present invention.

In FIG. 1, the dispenser 1 is generally parallelepiped in shape, comprising four sides and a top, housing as it does a rectangular stack of absorbent sheet products. The dispenser need not have a bottom, as the stack of absorbent sheet products could simply rest directly on a countertop; however, that possibility is less preferred to a dispenser that includes its own bottom, as shown in the depicted embodiments.

The dispenser includes an opening 2 in its top, which in this embodiment is generally circular. The shape of the opening is not critical, although circular is preferred. The opening could also be of octagonal shape, or of oblong shape, for example. It is preferred that the aspect ratio of the opening not exceed about 5:1, that is, that the opening not have a long dimension greater than about five times its shorter dimension.

It has been found that the area of the opening contributes to the one-at-a-time operation of the dispenser while preventing fallback of the paper towel stack disposed therein. In particular, it is preferred that the opening has a surface area in the range from about 0.78 $in^2$ to about 2.40 $in^2$, with a surface area of about 1.10 $in^2$ being particularly preferred. Tests on prototype dispensers having openings in this range of surface areas, using paper towel stacks as described hereinbelow, confirmed that one-handed serial dispensing could be performed consistently, and without fallback of the towels, even when the stack of towels was nearing the end.

It should be noted that the fallback avoidance provided according to the invention can be achieved without resorting to the use of a spring plate or other means urging the stack of towels upwardly within the dispenser. Thus, although the possible presence of such urging means is not disclaimed unless an appended claim so states, nevertheless, the structure of the inventive dispensers is such that urging means of this type are not essential.

The term Aabsorbent sheet products@ as used herein embraces not only paper products such as paper towels, but also absorbent nonwoven materials not normally classed as papers or tissues. Such nonwoven materials include pure nonwovens and hybrid nonwoven/pulp webs.

Figure 2:
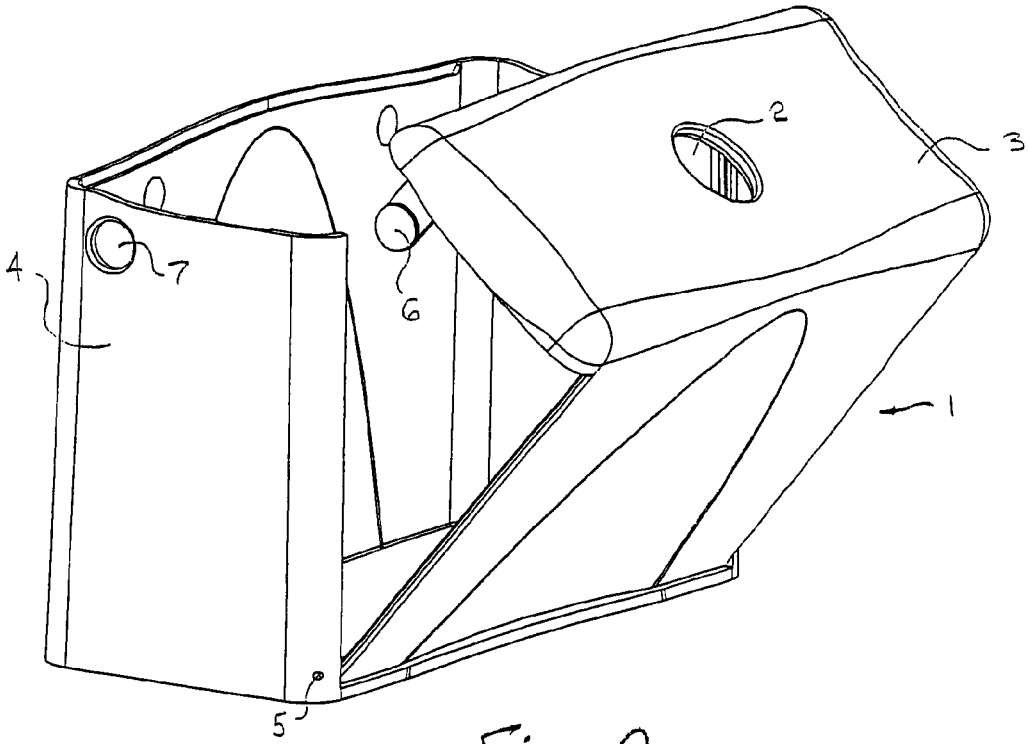
FIG. 2 is a view showing how the dispenser of FIG. 1 opens for loading of absorbent sheet products therein.

In FIG. 2, the dispenser is shown open for receiving a fresh stack of absorbent sheet products therein. As can be seen in FIG. 2, the dispenser is preferably formed of two main parts, each of which is preferably injection molded plastic. The front part 3 includes the top and front side, whereas the rear part 4 includes the bottom and the three other sides. The front part is pivotally connected to the rear part via integrally molded pins (not shown) received in corresponding openings 5 on the rear part. Integrally molded tabs 6 depend downwardly from the rear of the top side, and snap fit into corresponding openings 7 formed toward the rear of the side walls of the rear part 4, by virtue of the intrinsic resiliency of the plastic material and the thinned webs with which the tabs 6 are connected to the front part 3.

Another aspect relevant to the one-handed serial dispensing is that the dispenser not lift off the surface of the countertop when a towel is being withdrawn. One way of avoiding this is by gluing or otherwise fastening the container body to the countertop. However, the inventors' experimentation has shown that the container will be intrinsically heavy enough not to lift off a countertop surface, when its weight is at least about 24 oz. If the dispenser body does not already have at least that much weight, it can be made heavier, for example, by placing a metal plate in its bottom.

Figure 3:
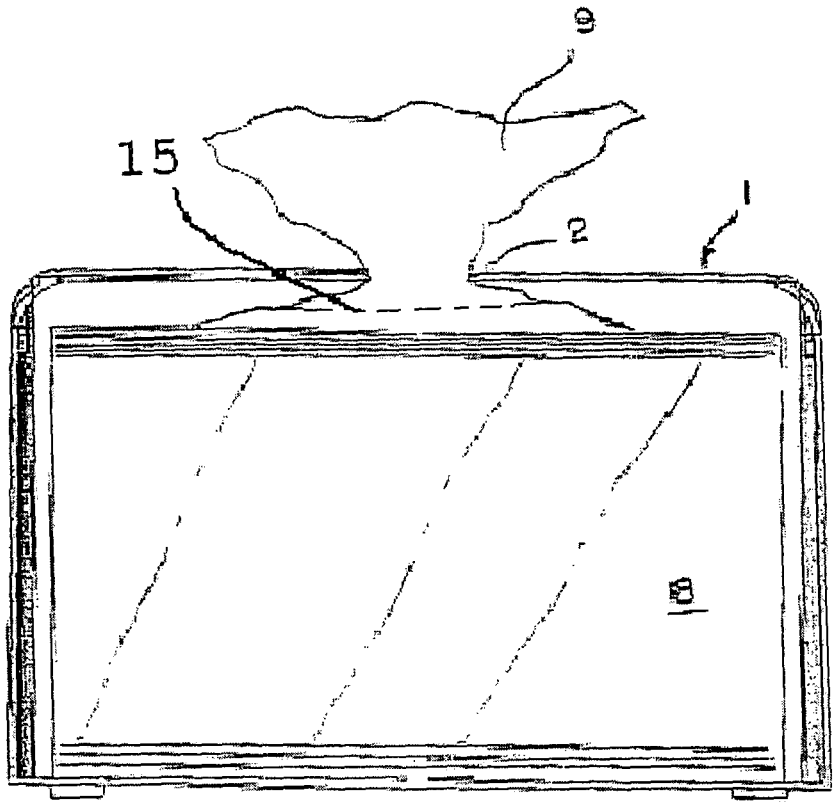
FIG. 3 is a cross sectional view of the dispenser of FIG. 1 taken along its long side, showing a stack of paper products disposed therein.

In FIG. 3, the dispenser is shown with a stack of interfolded paper towels disposed therein, according to an embodiment of the dispenser/absorbent sheet combination of the present invention. The stack 8 terminates upwardly in a sheet 9 that is projecting outwardly through the opening 2, but which remains attached via tabs 15 to the web of which it forms a part.

Figure 4A:
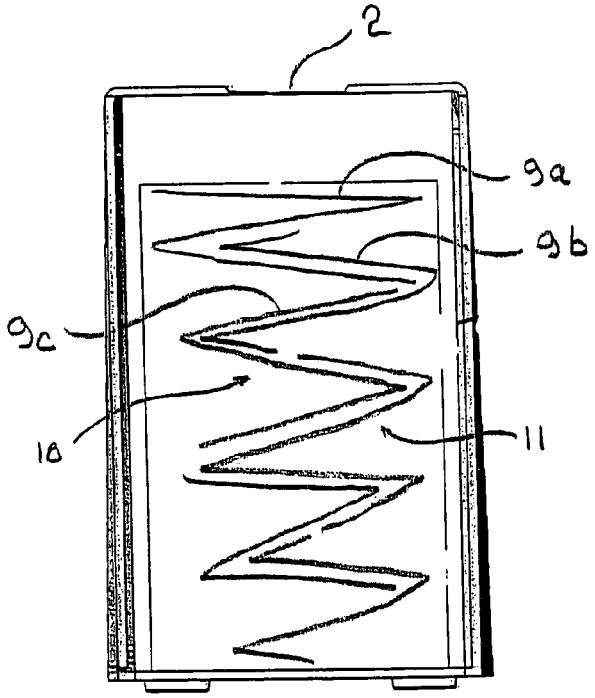
FIGS. 4(*a*) and 4(*b*) schematically depicts two preferred interfolded arrangements of a stack of towels for use in combination with the dispenser of the invention, viewed from the short side of the FIG. 1 dispenser.
Figure 4B:
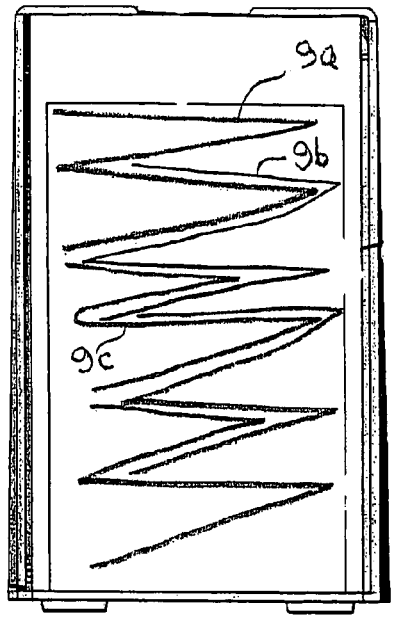

FIG. 4(*a*) shows an example of a paper towel stack preferred for use in the present invention. This can be a stack such as is sold commercially by SCA Tissue North America under the trade name "Tork Xpress Plus, 3-panel." In that product, each web is a two-ply series of interconnected towels in which each ply has a basis weight of about 13 lb per 3000 square feet, for an aggregate basis weight of about 26 lb. Alternatively, it is contemplated that each web may be a one-ply TAD (through-air dried) web having a basis weight of about 24 lb. More generally, it is contemplated that the towels for use in combination with the dispenser according to the invention will have a basis weight in the range form about 10 to about 40 lb per 3000 square feet.

FIG. 4(*a*), like FIG. 4(*b*), is exaggerated to show the interfolding of the dual webs. Whereas FIG. 4(*a*) shows only six absorbent sheets for ease of understanding, in reality a pack of towels having that interfold structure might typically include 144 towels in a 5.5" tall stack.

The dispenser itself of this embodiment has an interior height of about 6.5", such that there is about a one-inch gap from the opening 2 to the top of the fresh stack 8 of towels loaded therein. The length of the panel (short horizontal dimension of the stack 8) in this embodiment is 3¼", with the corresponding interior depth of the dispenser being slightly larger, about 3.625". The width of the sheets (long horizontal dimension of the stack 8) is about 9 inches in this embodiment, with the corresponding interior dimension of the dispenser 1 being about 9½".

As can be seen in FIG. 4(*a*), the stack is formed from two interfolded webs 10 and 11. Each web is continuous, in the sense that perforations or tabs interconnect all adjacent sheets within a given web. In the cross sectional view, the adjacent sheets within each web 10, 11 are shown separately for ease of understanding, but it is understood that the gaps between adjacent sheets on a given web thus merely fall between tabs in the sectional plane of the figure. In FIG. 4(*a*), it can be seen that each sheet, e.g. 9*a*, on a first web 10 overlaps by about 1½ panel lengths with the next sheet, e.g. 9*b*, on the adjacent web, which in turn overlaps about 1½ panel lengths with the subsequent sheet 9*c* on the first web.

A peculiarity of the three-panel towel of FIG. 4(*a*) in combination with a 1½ panel overlap between the adjacent webs, is that, whereas the sheet 9*a*, 9*c* of web 10 truly have three panels, the sheets 9*b* of web 11 actually have four panels with the end panels being half the length of the middle panels.

The sheets of the adjacent webs 10 and 11 can overlap to a greater or lesser extent, although it is preferred that they overlap by greater than one panel length. The sheets in the depicted embodiments are all of the same size on both webs, but it is possible, although less preferred, that the sheets could be of different lengths on different webs, or even of different lengths on a given web. Whatever the sheet lengths, however, the perforations of two consecutive sheets on adjacent webs should not be in alignment with one another.

In use, the dispenser 1 is loaded with a stack 8 of paper towels or other absorbent sheet product, with the dispenser open as in FIG. 2. Owing to the rather small size of opening 2, it is preferred to feed the first sheet 9 up through the opening 2 with the dispenser open, and then to close it, to achieve the starting condition shown in FIG. 3. The sheets may thereafter be withdrawn serially in a one-handed manner. In particular, with reference to FIG. 4(*a*), after a first sheet 9*a* is fed up through the opening 2, the sheet 9*a* is grasped by a user and pulled upwardly. The overlapping relationship between webs 10 and 11 causes the two webs to be pulled up together toward and through the opening, such that the frictional force opposing withdrawal causes the tabs interconnecting sheets 9*a* and 9*c* of web 10 to sever only after sheet 9*b* is projecting a sufficient distance through opening 2 as to be easily grasped by a next user, and as not to fall back down into the housing of the dispenser 1. The size and shape of the opening 2 according to the invention ensures that the withdrawal is not so easy that the tabs do not break between sheets 9*a* and 9*c*, but not so hard that the tabs break prematurely or that the sheet tears somewhere other than at the tabs.

In FIG. 4(*b*), a four-panel towel stack is shown, in which the towels of adjacent webs overlap by two panels. This embodiment is otherwise the same as that of FIG. 4(*a*), except that a four-panel stack of the same height as a three-panel stack provides only 108 panels for the same height as 144 towels in the three-panel stack.

Figure 5:
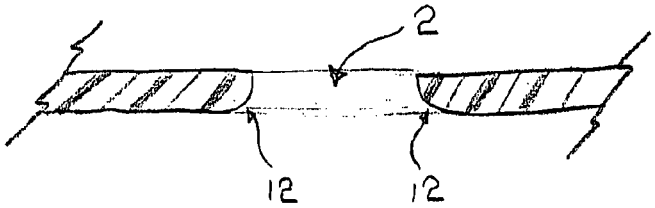
FIG. 5 is a fragmentary sectional view showing a preferred shape of the dispenser top opening.

FIG. 5 shows a fragmentary cross section of the opening 2. FIG. 5 emphasizes that the underside of the opening 2, which is the region of greatest frictional contact between the towels 9 being withdrawn and the dispenser, is preferably formed as a gradually rounded surface so as to minimize resistance to pulling as the towels 9 are withdrawn. A more abrupt corner would not necessarily disable the serial one-handed operation, which is more a function of the area of the opening, but would likely result in a less smooth and pleasing fell to the user as the towels are withdrawn.

While the present invention has been described in connection with various preferred embodiments thereof, it is to be understood that those embodiments are provided merely to illustrate the invention, and should not be used as a pretext to limit the scope of protection conferred by the true scope and spirit of the appended claims.

What is claimed is:

1. A dispenser for absorbent sheet products, comprising a plastic body configured to be refillable and that covers a stack of paper products to be disposed within said dispenser, said body comprising four sides and a top having an unobstructed opening on an upper surface thereof, said dispenser being free of a cover for said opening, wherein said body has a height greater than its width, wherein said opening has a surface area in the range from about 0.78 $in^2$ to about 2.40 $in^2$, wherein said opening has a maximum width less than a length and a width of a sheet to be dispensed through said opening, and wherein said opening is configured such that a stack of absorbent sheet products to be disposed within said dispenser, and formed of at least two interfolded webs of perforated absorbent sheet material in which the perforations of one web are not aligned with the perforations of an adjacent web, may be withdrawn through said opening one sheet at a time, by a user pulling on a first sheet of said one web protruding through said opening without the user needing to touch a next sheet on said adjacent web or a subsequent sheet on said one web, said next sheet on said adjacent web protruding through said opening each time a first sheet on said one web is withdrawn and detached from said one web, without said adjacent sheet falling downwardly from said opening back into said body, and wherein said body weighs at least about 24 oz. so as not to lift up off of a horizontal supporting surface when an absorbent sheet contained therein is withdrawn therefrom solely by pulling upwardly on said first sheet.

2. The dispenser according to claim 1, wherein said body further comprises a bottom adapted to support a stack of interfolded absorbent sheet products disposed in said dispenser.

3. The dispenser according to claim 1, wherein said dispenser is free of a structure for urging a stack of absorbent sheet products disposed therein upwardly toward said opening.

4. The dispenser according to claim 1, wherein said opening is generally circular.

5. The dispenser according to claim 1, wherein said surface area is about 1.10 $in^2$.

6. The dispenser according to claim 1, further comprising a stack of absorbent sheet products disposed within said dispenser.

7. The dispenser according to claim 6, wherein said stack of absorbent sheet products comprises at least two interfolded webs of perforated or tabbed material, wherein the perforations or tabs on one web are not aligned with the perforations or tabs on an adjacent web.

8. The dispenser according to claim 7, wherein the perforations or tabs on each web are equally spaced by a same amount, such that each sheet withdrawn from said dispenser is of a constant size.

9. The dispenser according to claim 8, wherein each sheet on each web is folded to form at least three panels per sheet.

10. The dispenser according to claim 9, wherein each said first sheet overlaps each said next sheet by greater than the length of one panel.

11. The dispenser according to claim 10, wherein each said first sheet overlaps each said next sheet by at least about 1.5 panel lengths.

12. The dispenser according to claim 6, wherein each said web is a paper having a basis weight in the range from about 10 lb to about 40 lb per 3000 $m^2$.

13. The dispenser according to claim 12, wherein each web is a two-ply web in which each ply has a basis weight of about 13 lb.

14. The dispenser according to claim 12, wherein each web is a one-ply TAD (through-air dried) web having a basis weight of about 24 lb.

15. A dispenser for absorbent sheet products, said dispenser comprising:

a body that covers a stack of paper products to be disposed within said dispenser, said body comprising two short sides defining the width of the dispenser and two longer sides defining the length of the dispenser, and a top having an unobstructed opening on an upper surface thereof, said dispenser having an absence of any cover for said opening, a bottom edge of one of said long sides being pivotally connected to respective bottoms of said two short sides; and a pair of locking tabs extending from said top and mating with corresponding openings in said short sides, wherein said body has a height greater than the width, wherein said opening has a surface area in the range from about 0.78 $in^2$ to about 2.40 $in^2$, wherein said opening has a maximum width less than a length and a width of a sheet to be dispensed through said opening, and wherein said opening has a size and shape configured so that a stack of absorbent sheet products to be disposed within said dispenser and that is formed of at least two interfolded webs of perforated absorbent sheet material in which the perforations of one web are not aligned with the perforations of an adjacent web is withdrawable through said opening one sheet at a time, by a user pulling on a first sheet of said one web protruding through said opening without the user needing to touch a next sheet on said adjacent web or a subsequent sheet on said one web, said next sheet on said adjacent web protruding through said opening each time a first sheet on said one web is withdrawn and detached from said one web, without said adjacent sheet falling downwardly from said opening back into said body.

16. A dispenser for absorbent sheet products, said dispenser comprising:

a refillable plastic body that covers a stack of paper products to be disposed within said dispenser, said body comprising two short sides defining a width of the dispenser and two longer sides defining a length of the dispenser, and a top having an unobstructed opening on an upper surface thereof, said dispenser having an absence of any cover for said opening, a bottom of one of said long sides being pivotally connected to respective bottoms of said two short sides, wherein said body has a height greater than the width along the entire height of the body, wherein said opening has a surface area in the range from about 0.78 $in^2$ to about 2.40 $in^2$, wherein said opening has a maximum width less than a length and a width of a sheet to be dispensed through said opening, and wherein said opening is configured such that a stack of absorbent sheet products to be disposed within said dispenser, and formed of at least two interfolded webs of perforated absorbent sheet material in which the perforations of one web are not aligned with the perforations of an adjacent web, may be withdrawn through said opening one sheet at a time, by a user pulling on a first sheet of said one web protruding through said opening without the user needing to touch a next sheet on said adjacent web or a subsequent sheet on said one web, said next sheet on said adjacent web protruding through said opening each time a first sheet on said one web is withdrawn and detached from said one web, without said adjacent sheet falling downwardly from said opening back into said body, and wherein said body weighs at least about 24 oz. so as not to lift up off of a horizontal supporting surface when an absorbent sheet contained therein is withdrawn therefrom solely by pulling upwardly on said first sheet.

* * * * *